US009773591B2

(12) United States Patent
Katter et al.

(10) Patent No.: US 9,773,591 B2
(45) **Date of Patent: *Sep. 26, 2017**

(54) ARTICLE FOR MAGNETIC HEAT EXCHANGE AND METHOD OF FABRICATING AN ARTICLE FOR MAGNETIC HEAT EXCHANGE

(75) Inventors: Matthias Katter, Alzenau (DE); Volker Zellmann, Linsengericht (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 1416 days.

This patent is subject to a terminal disclaimer.

(21) Appl. No.: 13/059,352

(22) PCT Filed: May 6, 2009

(86) PCT No.: PCT/IB2009/051854

§ 371 (c)(1),
(2), (4) Date: Apr. 25, 2011

(87) PCT Pub. No.: WO2010/128357

PCT Pub. Date: Nov. 11, 2010

(65) Prior Publication Data

US 2011/0198069 A1 Aug. 18, 2011
US 2012/0061066 A9 Mar. 15, 2012

(51) Int. Cl.
*H01F 1/055* (2006.01)
*H01F 1/01* (2006.01)
(Continued)

(52) U.S. Cl.
CPC ..... *H01F 1/017* (2013.01); *C21D 1/74* (2013.01); *C22C 33/0278* (2013.01);
(Continued)

(58) Field of Classification Search
None
See application file for complete search history.

(56) References Cited

U.S. PATENT DOCUMENTS 428,057 A 5/1890 Tesla
3,841,107 A 10/1974 Clark
(Continued)

FOREIGN PATENT DOCUMENTS

DE 103 38 467 A1 3/2004
DE 10330574 6/2004
(Continued)

OTHER PUBLICATIONS

Form PCT/IB/326; Form PCT/IB/373 and Form PCT/ISA/237 corresponding to PCT/IB/ 2009/051854 dated Nov. 17, 2011.
(Continued)

*Primary Examiner* — Xiaowei Su
(74) *Attorney, Agent, or Firm* — Dickinson Wright PLLC

(57) ABSTRACT

An article for magnetic heat exchange comprising a magnetocalorically active phase with a $NaZn_{13}$-type crystal structure is provided by hydrogenating a bulk precursor article. The bulk precursor article is heated from a temperature of less than 50° C. to at least 300° C. in an inert atmosphere and hydrogen gas only introduced when a temperature of at least 300° C. is reached. The bulk precursor article is maintained in a hydrogen containing atmosphere at a temperature in the range 300° C. to 700° C. for a selected duration of time, and then cooled to a temperature of less than 50° C.

17 Claims, 8 Drawing Sheets

(51) Int. Cl.

| | |
|---|---|
| ***C21D 1/74*** | (2006.01) |
| ***C22C 33/02*** | (2006.01) |
| ***C22C 38/00*** | (2006.01) |
| ***C22C 38/02*** | (2006.01) |
| ***C22C 38/04*** | (2006.01) |
| ***C22C 38/10*** | (2006.01) |
| ***F28F 21/08*** | (2006.01) |

(52) U.S. Cl.

CPC ..... *C22C 38/005* (2013.01); *C22C 38/02* (2013.01); *C22C 38/04* (2013.01); *C22C 38/10* (2013.01); *F28F 21/082* (2013.01); *H01F 1/015* (2013.01); *B22F 2998/10* (2013.01); *C22C 2202/02* (2013.01); *Y10T 29/4935* (2015.01)

(56) References Cited

U.S. PATENT DOCUMENTS

| | | | |
|---|---|---|---|
| 4,112,699 | A | 9/1978 | Hudson, III et al. |
| 4,322,257 | A | 3/1982 | Menth et al. |
| 4,332,135 | A | 6/1982 | Barclay et al. |
| 4,849,017 | A | 7/1989 | Sahashi et al. |
| 6,446,441 | B1 | 9/2002 | Dean |
| 6,588,215 | B1 | 7/2003 | Ghoshal |
| 6,676,772 | B2 | 1/2004 | Saito et al. |
| 6,826,915 | B2 | 12/2004 | Wada et al. |
| 7,063,754 | B2 | 6/2006 | Fukamichi et al. |
| 7,076,959 | B2 | 7/2006 | Lewis |
| 7,168,255 | B2 | 1/2007 | Saito et al. |
| 7,186,303 | B2 | 3/2007 | Kogure et al. |
| 7,670,443 | B2 | 3/2010 | Kogure et al. |
| 7,695,574 | B2 | 4/2010 | Nakajima |
| 7,914,628 | B2 | 3/2011 | Tsuji et al. |
| 8,037,692 | B2 | 10/2011 | Muller et al. |
| 2004/0079446 | A1 | 4/2004 | Kogure et al. |
| 2004/0093877 | A1 | 5/2004 | Wada et al. |
| 2004/0182086 | A1 | 9/2004 | Chiang et al. |
| 2004/0194855 | A1 | 10/2004 | Fukamichi et al. |
| 2004/0261420 | A1 | 12/2004 | Lewis |
| 2005/0172643 | A1 | 8/2005 | Lewis |
| 2006/0005898 | A1 | 1/2006 | Liu et al. |
| 2006/0076084 | A1 | 4/2006 | Nakajima |
| 2006/0213580 | A1 | 9/2006 | Tsuji et al. |
| 2006/0218936 | A1 | 10/2006 | Kobayashi et al. |
| 2006/0231163 | A1 | 10/2006 | Hirosawa et al. |
| 2007/0137732 | A1 | 6/2007 | Kogure et al. |
| 2007/0218319 | A1 | 9/2007 | Ohkoshi et al. |
| 2007/0220901 | A1 | 9/2007 | Kobayashi et al. |
| 2008/0078184 | A1 | 4/2008 | Saito et al. |
| 2008/0078476 | A1 | 4/2008 | Saito et al. |
| 2009/0071572 | A1* | 3/2009 | Fujita et al. ..... 148/121 |
| 2009/0194202 | A1 | 8/2009 | Tanigawa |
| 2010/0037625 | A1 | 2/2010 | Katter |
| 2010/0047527 | A1 | 2/2010 | Katter |
| 2010/0116471 | A1 | 5/2010 | Reppel et al. |
| 2010/0129794 | A1 | 5/2010 | Fabis et al. |
| 2011/0048690 | A1 | 3/2011 | Reppel et al. |
| 2011/0140031 | A1 | 6/2011 | Katter et al. |
| 2011/0151230 | A1 | 6/2011 | Katter |
| 2011/0168363 | A9 | 7/2011 | Reppel et al. |

FOREIGN PATENT DOCUMENTS

| | | | |
|---|---|---|---|
| DE | 10 2006 015 370 | A1 | 10/2006 |
| DE | 112007003401 | | 1/2010 |
| EP | 0 187 538 | A2 | 7/1986 |
| EP | 0 217 347 | B1 | 2/1993 |
| EP | 1 867 744 | A1 | 12/2007 |
| EP | 1 463 068 | B1 | 2/2009 |
| GB | 1076036 | | 7/1967 |
| GB | 2 424 901 | A | 10/2006 |
| GB | 2 458 039 | A | 9/2009 |
| GB | 2 459 066 | A | 10/2009 |
| GB | 2 460 774 | A | 12/2009 |
| JP | 60204852 | A | 10/1985 |
| JP | 62243377 | A | 10/1987 |
| JP | 63-055906 | | 3/1988 |
| JP | 02-190402 | | 7/1990 |
| JP | 4-338604 | A | 11/1992 |
| JP | 4-338605 | A | 11/1992 |
| JP | 7-320918 | A | 12/1995 |
| JP | 2000-54086 | | 2/2000 |
| JP | 3082195 | | 8/2000 |
| JP | 2000-274976 | A | 10/2000 |
| JP | 2002-69596 | | 3/2002 |
| JP | 2002-356748 | A | 12/2002 |
| JP | 2003-28532 | A | 1/2003 |
| JP | 2003096547 | A | 4/2003 |
| JP | 2005-036302 | A | 2/2005 |
| JP | 2005-93729 | | 4/2005 |
| JP | 2005-113209 | | 4/2005 |
| JP | 2005-120391 | A | 5/2005 |
| JP | 2006-89839 | A | 4/2006 |
| JP | 2006124683 | A | 5/2006 |
| JP | 2006-283074 | A | 10/2006 |
| JP | 2007-031831 | A | 2/2007 |
| JP | 2007031831 | A | 2/2007 |
| JP | 2007-084897 | A | 4/2007 |
| JP | 2007291437 | A | 11/2007 |
| JP | 2005-226125 | | 8/2008 |
| JP | 2009-249702 | A | 10/2009 |
| WO | WO 93/25857 | | 12/1993 |
| WO | WO 00/45397 | A1 | 8/2000 |
| WO | WO 2004/019379 | A2 | 3/2004 |
| WO | WO 2005/066980 | A2 | 7/2005 |
| WO | WO 2006/074790 | A1 | 7/2006 |
| WO | 2006107042 | A1 | 10/2006 |
| WO | WO 2007/026062 | A1 | 3/2007 |
| WO | WO 2007/065933 | A1 | 6/2007 |
| WO | WO 2008/099234 | A9 | 8/2008 |
| WO | WO 2008/099235 | A1 | 8/2008 |
| WO | WO 2009/090442 | A1 | 7/2009 |
| WO | WO 2010/038098 | A1 | 4/2010 |
| WO | WO 2010/128357 | A1 | 11/2010 |

OTHER PUBLICATIONS

An English Translation of the Office Action (First Examination Notice) dated Feb. 8, 2012, issued in Chinese Patent Application No. 2008800078121 corresponding to U.S. Appl. No. 12/526,199.

Notice of Reasons for Rejection dated Apr. 23, 2013, corresponding to Japanese Application No. JP2011-527429, 3 pgs.

Notice of Reasons for Rejection dated Oct. 1, 2013, corresponding to Japanese Application No. JP2011-527429, 2 pgs.

Decision of Rejection dated Jan. 22, 2014, corresponding to Japanese Application No. JP2011-527429, 2 pgs.

International Search Report dated Jan. 11, 2010 for International Application No. PCT/IB2009/051854.

Fujieda, S. et al., "Enhancement of Magnetocaloric Effects in $La_{1-z}Pr_z(Fe_{0.88}Si_{o.12})_{13}$ and their Hydrides," Journal of Applied Physics 102, 023907 (2007) American Institute of Physics (5 pages).

Fujieda, S. et al., "Strong Magnetocaloric Effects in $La_{1-z}Ce_z(Fe_{x-y}Mn_ySi_{1-x})_{13}$ at Low Temperatures," Applied Physics Letters 89, 062504 (2006) American Institute of Physics (3 pages).

Fujita, A. et al., "Control of Large Magnetocaloric Effects in Metamagnetic $La(Fe_xSi_{1-x})_{13}$ Compounds by Hydrogenation," Journal of Alloys and Compounds 404-406 (2005) pp. 554-558, Elsevier B.V. (5 pages).

Mandal, K. et al., "Magnetocaloric Effect in Reactively-Milled $LaFe_{11.57}Si_{1.43}H_y$ Intermetallic Compounds," Journal of Applied Physics 102, 053906 (2007) American Institute of Physics (5 pages).

Notice of Reasons for Rejection corresponding to JP 2010-511750 dated Sep. 13, 2011.

Examination Report under Section 18(3) corresponding to GB Application No. 1015392.2 dated Sep. 14, 2011.

Japanese Office Action corresponding to JP Patent Application No. 2010-504885 dated Nov. 1, 2011.

(56) References Cited

OTHER PUBLICATIONS

U.S. Appl. No. 12/523,199.
U.S. Appl. No. 12/526,199.
U.S. Appl. No. 12/526,669.
U.S. Appl. No. 12/595,217.
U.S. Appl. No. 12/809,152.
U.S. Appl. No. 13/058,838.
U.S. Appl. No. 13/058,841.
U.S. Appl. No. 13/026,137.
U.S. Appl. No. 13/026,150.
Barrett, C.S., "Crystal Structure of Metals," *ASM Handbook*, Formerly Ninth Edition, Metals Handbook, vol. 9, ASM International, Materials Park, OH (1985), pp. 8-9.
Bulanova, M. V. et al., "Lanthanum-silicon System," *Journal of Alloys and Compounds* 329 (2001) (pp. 214-223).
Chang, H. et al., "Theoretical Study of Phase Forming of $NaZn_{13}$-type Rare-Earth Intermetallics," *J. Phys.: Condens. Matter*, vol. 15 (2003) pp. 109-120 XP002385787.
Fujieda, S. et al., "Giant Isotropic Magnetostriction of Itinerant-Electron Metamagnetic $La(Fe_{0.88}Si_{0.12})_{13}H_y$ Compounds," Applied Physics Letters, vol. 79, No. 5, Jul. 30, 2001, pp. 653-655.
Fujieda, S. et al., "Large Magnetocaloric Effect in $La(Fe_xSi_{1-x})_{13}$ Itinerant-Electron Metamagnetic Compounds," *Applied Physics Letters*, vol. 81, No. 7, Aug. 12, 2002, American Institute of Physics (2002) pp. 1276-1278.
Fujita, A. et al., "Giant Magnetovolume and Magentocaloric Effects in Itinerant-Electron Metamagnetic $La(Fe_xSi_{1-x})_{13}$ Compounds," *Materia Japan*, vol. 41, No. 4, Apr. 20, 2002, pp. 269-275.
Fujita, A. et al., "Giant Volume Magnetostriction Due to the Itinerant Electron Metamagnetic Transition in $La(Fe—Si)_{13}$ Compounds," Department of Materials Science, Graduate School of Engineering, IEEE Transactions on Magnetics, vol. 35, No. 5, Sep. 1999 (pp. 3796-3798).
Hu, F. X. et al., "Magnetic Entropy Change in La $(Fe_{0.98}Co_{0.02})_{11.7}Al_{1.3}$," *J. Phys.: Condens. Matter*, vol. 12 (2000) L691-696.
Hu, F. X. et al., "Magnetic Entropy Change and its Temperature Variation in Compounds $La(Fe_{1-x}Co_x)_{11.2}Si_{1.8}$," *Journal of Applied Physics*, vol. 92, No. 7, Oct. 1, 2002, American Institute of Physics (2002) pp. 3620-3623.
Ji, J. F. et al., "A Novel Technique for Manufacturing Metal-bonded Nd—Fe—B Magnets by Squeeze Casting," *Metallurgical and Materials Transactions A* (Physical Metallurgy and Material Science) ISSN 1073-5623, 2002, vol. 33, No. 3, pp. 637-646 (10p.) and Abstract of the same.
Katter, M. et al., "Magnetocaloric Properties of $La(Fe, Co, Si)_{13}$ Bulk Material Prepared by Powder Metallurgy," Vacuumschmelze GmbH and Company KG, *IEEE Transactions on Magnetics*, vol. 44, No. 11, Nov. 2008 (pp. 3044-3047).
Kneller, E., "Ferromagnetismus," Springer-Verlag, 1962 (1 page).
Massalski, Th.B., "Diagram 1074," Binary Alloy Phase Diagrams, Ed. J.L. Murray, L.H. Benett, H. Backer, American Society of Metals Ohio, (1986) 1074.
Massalski, Th.B., "Diagram 1108," Binary Alloy Phase Diagrams, Ed. J.L. Murray, L.H. Benett, H. Backer, American Society of Metals Ohio, (1986) 1108.
Otani, Y. et al., "Metal Bonded $Sm_2Fe_{17}N_{3-\delta}$magnets," Department of Pure and Applied Physics, Trinity College, Dublin 2, Ireland, *J. Appl. Phys.* 69 (9), May 1, 1991, 1991 American Institute of Physics, pp. 6735-6737.
Richard, M.A. et al., "Magnetic Refrigeration: Single and Multimaterial active Magnetic Regenerator Experiments," *Journal of Applied Physics*, vol. 95, No. 4, Feb. 15, 2004, pp. 2146-2150, American Institute of Physics (6 pages).
Saito, A. T. et al., "Magnetocaloric Effect of New Spherical Magnetic Refrigerant Particles of $La(Fe_{1-x-y}Co_xSi_y)_{13}$ Compounds," *ScienceDirect, Journal of Magnetism and Magnetic Materials 310* (2007) 2808-2810, www.sciencedirect.com (pp. 2808-2810).
Tishin, A.M. et al., "The Magnetocaloric Effect and its Applications," Institute of Physics Publishing, Bristol and Philadelphia, IOP Publishing Ltd. 2003, pp. 371-375.
Villars, P. et al., "Diagram 10375," *Handbook of Ternary Alloy Phase Diagrams*, 2nd Ed., ASM International, 10 (1997) 10375 (1 page).
Villars, P. et al., "Diagram 8502," *Handbook of Ternary Alloy Phase Diagrams*, 2nd Ed., ASM International, 7 (1997) 8502 (1 page).
Wang, J. et al., "The Hydrogenation Behavior of $LaFe_{11.44}Si_{1.56}$ Magnetic Refrigerating Alloy," *Journal of Alloys and Compounds*, vol. 485 (2009) pp. 313-315, Elsevier B.V. (3 pages).
Zhang, H. et al., "The Spike in the Relation Between Entropy Change and Temperature in $LaFe_{11.83}Si_{1.17}$ Compound," ScienceDirect, *Journal of Magnetism and Magnetic Materials* 320 (2008) 1879-1883, www.sciencedirect.com (pp. 1879-1883).
Zhang, X. X. et al., "Magnetic Entropy Change in Fe-based Compound $LaFe_{10.6}Si_{2.4}$," Applied Physics Letters, vol. 77, No. 19, Nov. 16, 2000, pp. 3072-3074 (2000) American Institute of Physics.
Zimm, C. et al., "Description and Performance of a Near-Room Temperature Magnetic Refrigerator," *Advances in Cryogenic Engineering*, vol. 43, Plenum Press, New York, (1998) pp. 1759-1766.

* cited by examiner

ARTICLE FOR MAGNETIC HEAT EXCHANGE AND METHOD OF FABRICATING AN ARTICLE FOR MAGNETIC HEAT EXCHANGE

BACKGROUND

1. Field

The present application relates to an article for magnetic heat exchange, in particular an article for use as a working medium in a magnetic heat exchanger, and methods of fabricating an article for magnetic heat exchange.

2. Description of Related Art

Magnetic heat exchangers include a magnetocalorically active material as the working medium to provide cooling and/or heating. A magnetocalorically active material exhibits the magnetocaloric effect. The magnetocaloric effect describes the adiabatic conversion of a magnetically induced entropy change to the evolution or absorption of heat. By applying a magnetic field to a magnetocalorically active material, an entropy change can be induced which results in the evolution or absorption of heat. This effect can be harnessed to provide refrigeration and/or heating.

The magnetic entropy of the material changes depending on whether a magnetic field is applied or not owing to the difference between the degrees in freedom of the electron spin system. With this entropy change, entropy transfers between the electron spin system and the lattice system.

A magnetocalorically active phase, therefore, has a magnetic phase transition temperature $T_{trans}$ at which this phase change occurs. In practice, this magnetic phase transition temperature translates as the working temperature. Therefore, in order to provide cooling over a wider temperature range, the magnetic heat exchanger requires magnetocalorically active material having several different magnetic phase transition temperatures.

A variety of magnetocalorically active phases are known which have magnetic phase transition temperatures in a range suitable for providing domestic and commercial air conditioning and refrigeration. One such magnetocalorically active material, disclosed for example in U.S. Pat. No. 7,063,754, has a $NaZn_{13}$-type crystal structure and may be represented by the general formula $La(Fe_{1-x-y}T_yM_x)_{13}H_z$, where M is at least one element of the group consisting of Si and Al, and T may be one of more of transition metal elements such as Co, Ni, Mn and Cr. The magnetic phase transition temperature may be adjusted by adjusting the composition.

In addition to a plurality of magnetic phase transition temperatures, a practical working medium should also have a large entropy change in order to provide efficient heating. However, elemental substitutions which lead to a change in the magnetic phase transition temperature can also lead to a reduction in the entropy change observed.

SUMMARY

Therefore, it is desirable to provide a material for use as the working medium in a magnetic heat exchanger which can be fabricated to have a range of different magnetic phase transition temperatures as well as a large entropy change. It is also desirable that the material can be fabricated in a physical form which can be incorporated reliably into a practical magnetic heat exchanger.

The application provides an article for use as a working medium in a magnetic heat exchanger which comprises a magnetocalorically active phase with a $NaZn_{13}$-type crystal structure and hydrogen. The article has at least one dimension which is greater than 5 mm (millimeters). In further embodiments, the article has at least one dimension greater than 10 mm.

A magnetocalorically active material is defined herein as a material which undergoes a change in entropy when it is subjected to a magnetic field. The entropy change may be the result of a change from ferromagnetic to paramagnetic behaviour, for example.

A magnetocalorically passive material is defined herein as a material which exhibits no significant change in entropy when it is subjected to a magnetic field.

A magnetic phase transition temperature is defined herein as a transition from one magnetic state to another. Some magnetocalorically active phases exhibit a transition from antiferromagnetic to ferromagnetic which is associated with an entropy change. Some magnetocalorically active phases such as $La(Fe_{1-x-y}T_yM_x)_{13}H_z$ exhibit a transition from ferromagnetic to paramagnetic which is associated with an entropy change. For these materials, the magnetic phase transition temperature can also be called the Curie temperature.

The magnetocalorically active phase may be described by the formula $La_{1-a}R_a(Fe_{1-x-y}T_yM_x)_{13}H_z$. M is at least one element from the group consisting of Si and Al, T is at least one element from the group consisting of Co, Ni, Mn and Cr, R is at least one rare earth metal such as Ce, Nd and Pr and $0 \le a \le 0.5$, $0.05 \le x \le 0.2$, $0 \le y \le 0.2$ and $0 \le z \le 3$.

An article with at least one dimension greater than 5 mm is more practical to use in a heat exchanger than a magnetocalorically active phase in the form of a powder. Although a powder has a larger surface area which should, in principle, lead to a better heat exchange with a heat exchange medium such as a fluid in which it is in contact, in practice the use of powder has the disadvantage that it must be contained within a further vessel and not pumped around the heat exchanger system with the heat exchange medium.

It is also found that the average particle size of the powder tends to decrease over its working life since it is impacted onto the side walls of the vessel due to the movement of the heat exchange medium. Therefore, larger solid articles are desirable to avoid these problems.

The article may be polycrystalline and may be a polycrystalline sintered or reactive sintered article that is fabricated by sintering or reactive sintering particles together to produce a solid polycrystalline article.

The term "reactive sintered" describes an article in which grains are joined to congruent grains by a reactive sintered bond. A reactive sintered bond is produced by heat treating a mixture of precursor powders of differing compositions. The particles of different compositions chemically react with one another during the reactive sintering process to form the desired end phase or product. The composition of the particles, therefore, changes as a result of the heat treatment. The phase formation process also causes the particles to join together to form a sintered body having mechanical integrity.

Reactive sintering differs from conventional sintering since, in conventional sintering, the particles consist of the desired end phase before the sintering process. The conventional sintering process causes a diffusion of atoms between neighbouring particles so as join the particles to one another. The composition of the particles, therefore, remains unaltered as a result of a conventional sintering process.

In further embodiments, the hydrogen is accommodated interstitally in the $NaZn_{13}$ crystal structure and comprises at least one dimension greater than 10 mm. For example, the article may comprise a reactive sintered polycrystalline plate having dimensions of 11 mm×6 mm×0.6 mm. The article may comprise a hydrogen content in the range 0.02 wt % to 0.3 wt % and may have a magnetic phase transition temperature in the range −40° C. to +150° C.

The present application, therefore, provides methods by which an article having at least one dimension of greater than 10 mm which comprises a magnetocalorically active phase with a $NaZn_{13}$-type crystal structure and hydrogen can be fabricated.

The magnetocalorically active phase may be described by $La_{1-a}R_a(Fe_{1-x-y}T_yM_x)_{13}H_z$, wherein M is at least one element from the group consisting of Si and Al, T is at least one element from the group consisting of Co, Ni, Mn and Cr, R is at least one element from the group consisting of Ce, Nd and Pr and $0 \leq a \leq 0.5$, $0.05 \leq x \leq 0.2$, $0 \leq y \leq 0.2$ and $0 \leq z \leq 3$, preferably $0.02 \leq z \leq 3$.

In an embodiment, a method of fabricating an article for magnetic heat exchange comprises hydrogenating a bulk precursor article comprising a magnetocalorically active phase with a $NaZn_{13}$-type crystal structure is provided. The bulk precursor article is initially hydrogen-free and is subsequently hydrogenated by heating the bulk precursor article from a temperature of less than 50° C. to at least 300° C. in an inert atmosphere and introducing hydrogen gas only when a temperature of at least 300° C. is reached. The bulk precursor article is maintained in a hydrogen containing atmosphere at a temperature in the range 300° C. to 700° C. for a selected duration of time, and afterwards cooled to a temperature of less than 50° C. to produce a hydrogenated article.

The magnetocalorically active phase of the bulk precursor article before hydrogenation comprises a hydrogen content, z, of less than 0.02 wt %. In an embodiment, the temperature of less than 50° C. is room temperature and may lie in the range of 18° C. to 25° C.

As used herein "bulk" is used to denote a precursor article or a final product article other than a powder and specifically excludes a powder. A powder includes a number of particles having a diameter of 1 mm (millimeter) or less.

This method enables bulk precursor articles, which have been previously fabricated, for example by melting and solidification techniques as well as by sintering or reactive sintering powders to form sintered or reactive sintered blocks, to be subsequently be hydrogenated whilst retaining with mechanical properties of the unhydrogenated block. In particular, it is found that if hydrogen is introduced at temperatures lower than around 300° C., the bulk precursor article may disintegrate into pieces or at least lose its previous mechanical strength. However, these problems may be avoided by first introducing hydrogen when the bulk precursor article is at a temperature of at least 300° C.

The method may be used to fabricate articles having differing hydrogen contents and, therefore, different magnetic phase transition temperatures by adjusting the parameters used to hydrogenate the article so that the hydrogen content of the article differs.

In a first group of embodiments, a fully hydrogenated or near fully hydrogenated article may be fabricated by cooling the article to a temperature of less than 50° C., for example to room temperature, in a hydrogen-containing atmosphere. A fully or near fully hydrogenated article is defined as one having a hydrogen content, z, of 1.7 to 3.

The selected duration of heat treatment time at the temperature in the range of 300° C. to 700° C. may lie in the range 1 minute to 4 hours in the first group of embodiments. After hydrogenation, the article may comprise at least 0.21 wt % hydrogen and a magnetic phase transition temperature, $T_{trans}$, in the range of −40° C. to +150° C.

The lower magnetic phase transition temperatures may be obtained by substituting a portion of the element La by Ce, Pr and/or Nd or by substituting a portion of the element Fe by Mn and/or Cr. The higher magnetic phase transition temperatures may be obtained by substituting a portion of the element Fe by Co, Ni, Al and/or Si.

These magnetic phase transition temperatures and hydrogen content are typical of a fully hydrogenated or near fully hydrogenated material. The article may be cooled at a rate of 0.1 to 10K/min in a hydrogen containing atmosphere. Such a cooling rate may be achieved by furnace cooling depending on the size and construction of the furnace.

In a second group of embodiments, the parameters used to carry out hydrogenation are adjusted in order to adjust the hydrogen content of the article and adjust the magnetic phase transition temperature of the article in the range of −40° C. to 150° C. In the second group of embodiments, the bulk precursor article is partially hydrogenated.

In an embodiment, the hydrogen gas is replaced by inert gas before cooling the article to a temperature of less than 50° C. In other words, after the heat treatment in a hydrogen containing atmosphere for the selected duration of time at a temperature in the range of 300° C. to 700° C., the hydrogen containing atmosphere is exchanged for inert gas at this temperature before cooling begins.

This method produces a partially hydrogenated article, i.e. an article with a hydrogen content which is less than that achieved by the first group of embodiments described above which produce a fully hydrogenated or near fully hydrogenated article. This embodiment may be used to fabricate an article having a magnetic phase transition temperature which is up to 60K higher than the magnetic phase transition temperature of the hydrogen-free precursor.

In a further embodiment, the article is cooled from the dwell temperature in the range 300° C. to 700° C. to a temperature in the range 300° C. to 150° C. in a hydrogen containing atmosphere. The hydrogen is then replaced by inert gas and the article cooled to a temperature of less than 50° C.

This embodiment may be used to fabricate an article having a magnetic phase transition temperature which is 60K to 140K higher than the magnetic phase transition temperature of the hydrogen-free precursor since the uptake of hydrogen may be larger than an embodiment in which the hydrogen gas is exchanged for an inert gas at the dwell temperature.

For this second group of embodiments, the selected duration of time may be 1 minute to 4 hours. After hydrogenation, the article may comprises a hydrogen content in the range of 0.02 wt % to 0.21 wt %. The article may be cooled at a rate of 1 K/min to 100 K/min. This cooling rate is somewhat faster than that used to produce a fully hydrogenated or near fully hydrogenated article. Such a cooling rate may be provided by forced gas cooling of the furnace and/or removing the heating jacket from the working chamber of the furnace.

For both groups of embodiments described above, the method may be further modified as follows.

The bulk precursor article has initial outer dimensions before hydrogenation and the final article after hydrogenation has final outer dimensions. In an embodiment, the difference between the initial outer dimensions and final outer dimensions is less than 10%. The article largely retains its initial dimensions since it no longer disintegrates and loses its mechanical integrity during the hydrogenation method. The final outer dimensions may however differ slightly from the initial outer dimensions as a result of the accommodation of hydrogen within the crystal lattice of the magnetocalorically active phase of the article.

In further embodiments, hydrogen gas is introduced only when a temperature of 400° C. to 600° C. is reached. These embodiments can be used to provide an article after hydrogenation with an improved mechanical strength.

In the above second group of embodiments, partially hydrogenated articles are fabricated by adjusting the amount of hydrogen introduced into the article during a single heat treatment.

In a further method, pre-hydrogenated articles are provided and then partially dehydrogenated to reduce the hydrogen content and change the magnetic phase transition temperature of the article.

This further method of fabricating an article for magnetic heat exchange comprises providing a polycrystalline sintered or reactive sintered article comprising a magnetocalorically active phase with a $NaZn_{13}$-type crystal structure and at least 0.2 wt % hydrogen and performing at least a partial dehydrogenation of the article. The at least partial dehydrogenation may be performed by heating the article in inert gas at a temperature of 150° C. to 400° C. for a selected duration of time, and rapidly cooling the article to a temperature of less than 50° C. in an inert atmosphere. The article may be placed into a furnace pre-heated to a temperature in the range of 150° C. to 400° C.

The initially fully hydrogenated or near fully hydrogenated articles are partially dehydrogenated in order to fabricate articles comprising a magnetic phase transition temperature between that of hydrogen-free phase and the fully hydrogenated phase. However, the article may be completely dehydrogenated as the hydrogenation process is fully reversible if the hydrogenation and dehydrogenation conditions are selected so as to prevent decomposition of the magnetocalorically active phase with the $NaZn_{13}$-type crystal structure.

In an embodiment, the article is rapidly cooled by quenching. This may be performed by rapidly moving the article from the hot zone of a furnace to a peripheral end of the working chamber outside of the hot zone. The article is then maintained in the inert gas within the furnace chamber whilst being quenched. Oxidation of the article can be avoided.

In an embodiment, the selected duration of time is extended to reduce the hydrogen content of the fully or near fully article. The hydrogen content of the article may be reduced generally logarithmically with respect to increased time at the dwell temperature.

BRIEF DESCRIPTION OF THE DRAWINGS

Embodiments will now be described with reference to the accompanying drawings.

DETAILED DESCRIPTION OF SPECIFIC EMBODIMENTS

Figure 1:
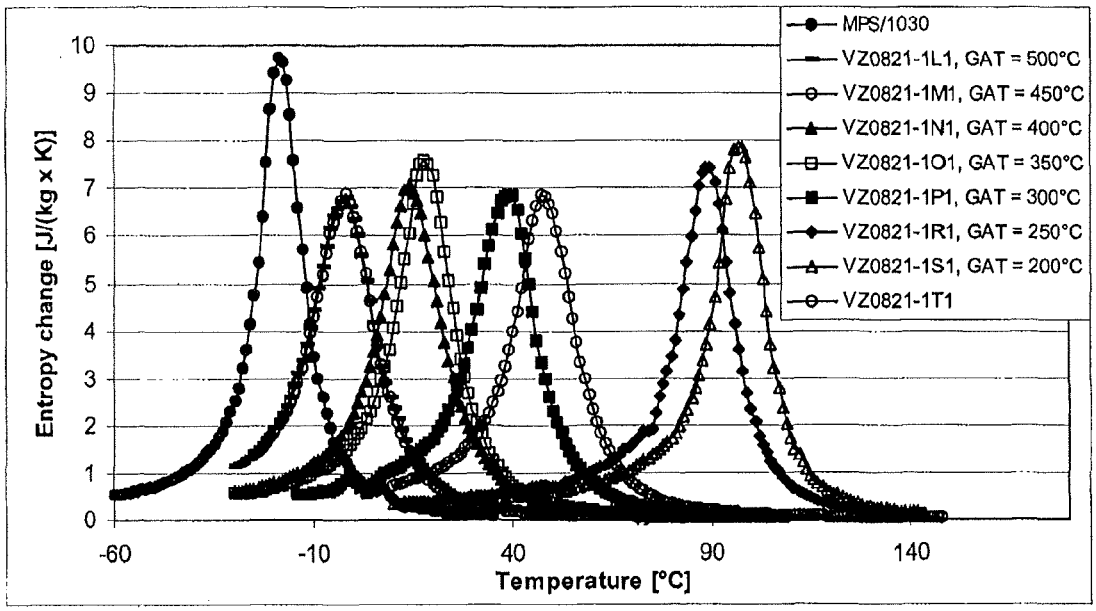
FIG. 1 illustrates a graph of the change in entropy as a function of temperature for partially hydrogenated articles.

An article for use as the working medium in a magnetic heat exchanger may be fabricated by hydrogenating bulk precursor article comprising a magnetocalorically active phase with a $NaZn_{13}$-type crystal structure.

In an embodiment, the bulk precursor article comprises one or more $La(Fe_{1-x-y}T_yM_x)_{13}$-based phases and comprises 16.87 wt % La, 3.73 wt % Si, 4.61 wt % Co and remainder iron. Each bulk precursor article has initial dimensions of around 11.5 mm×6 mm×0.6 mm and a magnetic phase transition temperature of −18.5° C., an entropy change of 9.4 J/(kg·K) for a magnetic field change of 1.6 T and 5.7% alpha-Fe (α-Fe). The peak width (entropy change as a function of temperature) is 13.7° C.

The bulk precursor article is polycrystalline and may be fabricated by sintering compacted powder comprising the hydrogen-free magnetocalorcially active phase or by reactive sintering precursor powders having an overall composition corresponding to the desired hydrogen-free magnetocalorically active phase to form the desired hydrogen-free magnetocalorically active phase.

The α-Fe content was measured using a thermomagnetic method in which the magnetic polarization of a sample heated above its Curie Temperature is measured as the function of temperature of the sample when it is placed in an external magnetic field. The paramagnetic contribution, which follows the Curie-Weiss Law, is subtracted and the content of alpha Fe is deduced from the remaining ferromagnetic signal.

The bulk precursor articles were hydrogenated by wrapping 5 bulk precursor articles in iron foil, placing them in a furnace and heating the bulk precursor articles from a temperature of less than 50° C. to a selected temperature in the range 100° C. to 700° C. in an inert atmosphere, in particular, in argon. Hydrogen gas was introduced into the furnace only when the temperature 100° C. to 700° C. was reached. Hydrogen gas at a pressure of 1.9 bar was introduced into the furnace and the article held in a hydrogen containing atmosphere at the selected temperature for a selected duration of time or dwell time. In this embodiment, the dwell time was 2 hours. Afterwards, the articles were furnace cooled in the hydrogen containing atmosphere at a mean cooling rate of about 1 K/min to a temperature of less than 50° C.

The articles heat treated at a temperature of 100° C. and 200° C. were found to have disintegrated into powder and the outermost portions of the article heat treated at 300° C. were observed to have broken away. The articles heat treated at 400° C., 500° C., 600° C. and 700° C. were all found to be intact after the hydrogenation heat treatment.

The magnetocaloric properties of entropy change, peak magnetic phase transition temperature and peak width as well as the measured alpha-iron content are summarized in Table 1.

TABLE 1

| Sample | Heat treatment | max, Entropy change $\Delta S'_{m.max}$, [J/(kg · K)] | Peak temperature [° C.] | Peak width [° C.] | Alpha Fe content [%] |
|---|---|---|---|---|---|
| MPS-1030 | none | 9.36 | −18.5 | 13.7 | |
| VZ0821-1A1 | HST = 100° C. | 6.58 | 113.1 | 18.1 | 6.8 |
| VZ0821-1B1 | HST = 200° C. | 8.97 | 117.1 | 12.1 | 6.6 |
| VZ0821-1C1 | HST = 300° C. | 8.49 | 113.6 | 14.0 | 6.2 |
| VZ0821-1D1 | HST = 400° C. | 7.46 | 112.3 | 16.3 | 7.0 |
| VZ0821-1E1 | HST = 500° C. | 8.18 | 120.0 | 13.8 | 7.5 |
| VZ0821-1F1 | HST = 600° C. | 8.67 | 118.5 | 12.9 | 6.6 |
| VZ0821-1G1 | HST = 700° C. | 2.14 | 44.9 | 18.0 | 45.6 |

Articles heated at a hydrogenation temperature between 100° C. and 600° C. have an increased magnetic phase transition temperature of between 112° C. and 120° C. compared to a value of −18.5° C. for the unhydrogenated bulk precursor article. For a hydrogenation temperature of 700° C., an increased alpha-iron proportion as well as a lower magnetic phase transition temperature of around 45° C. and increased peak width of 18° C. was observed indicating that the magnetocalorically active phase has partially decomposed.

The hydrogen content was determined using chemical methods for the samples and the measured values are summarised in Table 2. The hydrogen content of all the articles lies within 0.2325 wt % and 0.2155 wt %.

TABLE 2

| Sample | Hydrogen content [%] | ratio La:H |
|---|---|---|
| comparison, unhydrogenated state | 0.0090 | |
| HST = 100° C. | 0.2310 | 1:1.91 |
| HST = 200° C. | 0.2325 | 1:1.92 |
| HST = 300° C. | 0.2325 | 1:1.92 |
| HST = 400° C. | 0.2210 | 1:1.82 |
| HST = 500° C. | 0.2195 | 1:1.81 |
| HST = 600° C. | 0.2185 | 1:1.80 |
| HST = 700° C. | 0.2155 | 1:1.78 |

The magnetic phase transition temperature of an article for use as the working medium in a magnetic heat exchanger translates into its operating temperature. Therefore, in order to be able to provide cooling and/or heating over a large temperature range, a working medium comprising a range of different magnetic phase transition temperatures is desirable.

In principle, by hydrogenating bulk samples so that the hydrogen content of the article varies, i.e. by partially hydrogenating the article, different magnetic phase transition temperatures may be provided. Therefore, a plurality of articles of different magnetic phase transition temperature may be used together as the working medium in the magnetic heat exchanger so as to increase the operating range of the heat exchanger.

In a first group of experiments, the hydrogenation conditions were adjusted in order to control the amount of hydrogen taken up by the article so that articles of differing hydrogen content and differing magnetic phase transition temperatures can be produced.

Five bulk precursor articles having a size and composition as listed above were wrapped in iron foil and heated in inert gas to a hydrogenation temperature in the range 300° C. to 500° C. At the hydrogenation temperature, the inert gas was exchanged for 1.9 bar of hydrogen and the articles held at the hydrogenation temperature for 10 minutes. After 10 minutes, the hydrogen was exchanged for inert gas, the heating element was removed from the furnace and the working chamber of the furnace cooled with forced air as fast as possible to a temperature below 50° C.

For two samples, hydrogenation was carried out at 350° C. and 450° C., respectively, and the samples cooled to 200° C. and 250° C., respectively, before the hydrogen was exchanged for argon.

For hydrogenation temperatures of 350° C. and above, the articles were found to be intact. Also the two samples at which the gas exchange took place at 200° C. and 250° C., but which were initially heated in a hydrogen-containing atmosphere at a temperature above 350° C. were also found to be intact after the heat treatment.

The measured magnetocaloric properties of the samples are summarised in Table 3. The entropy change of the samples was measured for a magnetic field change of 1.6 T and the results are illustrated in FIG. 1.

TABLE 3

| Sample | Heat treatment | Entropy change $\Delta S'_{m.max}$, [J/(kg · K)] | Peak temperature $T_C$ [° C.] | Peak width $\Delta T_{WHH}$ [° C.] |
|---|---|---|---|---|
| MPS-1030 | None starting material | 9.4 | −18.5° C. | 13.7 |
| VZ0821-1L1 | TH = 500° C., 10 min, gas exchange | 6.6 | −3.2° C. | 20.3 |
| VZ0821-1M1 | TH = 450° C., 10 min, gas exchange | 6.6 | −2.9° C. | 19.8 |
| VZ0821-1N1 | TH = 400° C., 10 min, gas exchange | 6.9 | 14.2° C. | 19.4 |
| VZ0821-1O1 | TH = 350° C., 10 min, gas exchange | 7.4 | 17.8° C. | 17.5 |
| VZ0821-1P1 | TH = 300° C., 10 min, gas exchange | 6.8 | 37.6° C. | 18.9 |
| VZ0821-1R1 | TH = 450° C., OK auf 250° C. gas exchange | 7.3 | 88.7° C. | 16.8 |
| VZ0821-1S1 | TH = 350° C., OK auf 200° C. gas exchange | 7.7 | 97.0° C. | 15.9 |

Figure 2:
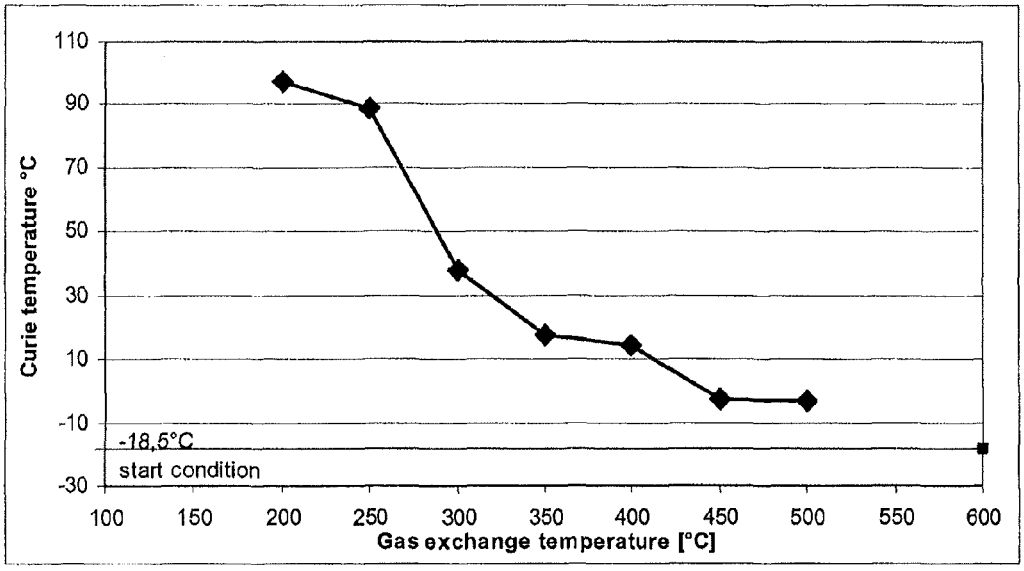
FIG. 2 illustrates a graph of Curie temperature as a function of gas exchange temperature for the articles of FIG. 1.

The relationship between the magnetic phase transition temperature and the gas exchange temperature is also illustrated in FIG. 2. FIG. 2 shows a general trend that with increasing gas exchange temperature, the magnetic phase transition temperature decreases. In the temperature region from 250° C. to 300° C. a strong dependence of the magnetic phase transition temperature with the gas exchange temperature is observed.

Figure 3:
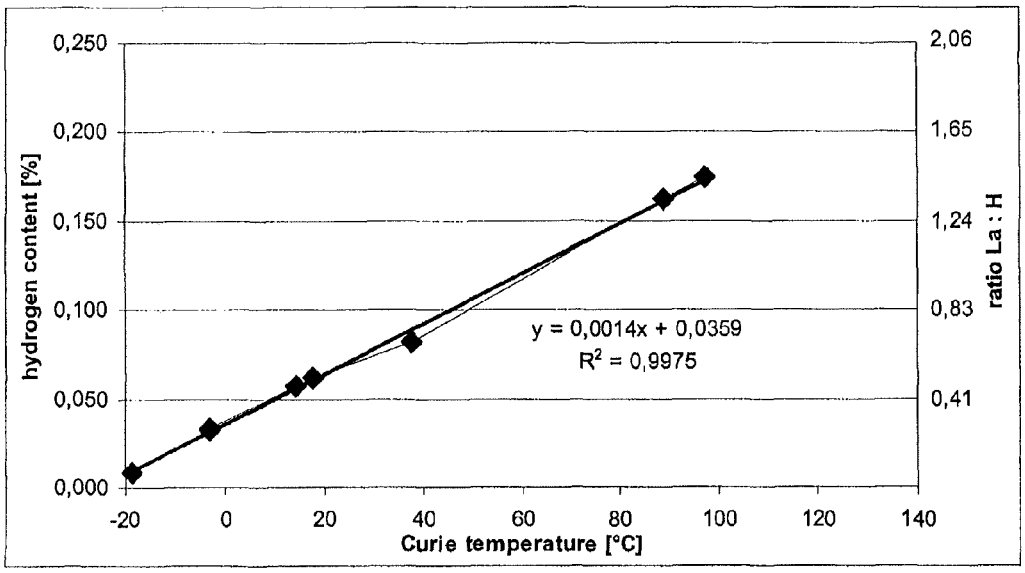
FIG. 3 illustrates a graph of the hydrogen content as a function of Curie temperature for the articles of FIG. 1.

The hydrogen content of the samples was determined using chemical techniques and the results are summarised in Table 4 and FIG. 3. FIG. 3 illustrates a generally linear relationship between the magnetic phase transition temperature and the measured hydrogen content of the samples.

TABLE 4

| sample | Hydrogen content [%] | ratio La:H |
|---|---|---|
| comparison | 0.0090 | |
| GAT = 500° C. | 0.0324 | 1:0.27 |
| GAT = 450° C. | 0.0337 | 1:0.28 |
| GAT = 400° C. | 0.0576 | 1:0.48 |
| GAT = 350° C. | 0.0621 | 1:0.51 |
| GAT = 300° C. | 0.0818 | 1:0.68 |
| GAT = 250° C. | 0.1615 | 1:1.33 |
| GAT = 200° C. | 0.1750 | 1:1.44 |

Curie temperatures in the range of −3.2° C. and 97° C. and hydrogen contents in the range of 0.0324 wt % and 0.1750 wt % were obtained.

This method therefore, enables polycrystalline sintered or reactive sintered articles for use as the working medium in the heat exchanger to be fabricated with differing magnetic phase transition temperatures and differing hydrogen content.

A set of articles having differing Curie temperatures may be used together as the working medium of a magnetic heat exchanger in order to extend the operating range of the magnetic heat exchanger. The magnetic heat exchanger is able to heat and/or cool over a temperature range generally corresponding to the range of the magnetic phase transition temperatures of the working medium.

In a second set of embodiments, articles with differing magnetic phase transition temperatures were fabricated by dehydrogenating fully hydrogenated or near fully hydrogenated bulk precursor articles comprising the magnetocalorically active phase described above.

The hydrogenated bulk precursor articles were fabricated by heating the samples in an inert gas to 450° C. and, at 450° C., exchanging the inert gas for 1.9 bar of hydrogen. After a dwell time of two hours at 450° C. in the hydrogen atmosphere, the samples were furnace cooled in a hydrogen atmosphere to a temperature of less than 50° C.

To partially dehydrogenate the now fully hydrogenated or near fully hydrogenated articles, the articles were heated at one of three different temperatures 200° C., 250° C. and 300° C. for different times in air. In particular, 10 samples were placed in a preheated oven and then the samples removed individually after a different dwell time in a range of 10 minutes to 1290 minutes. The magnetocaloric properties of the samples were measured.

Figure 4:
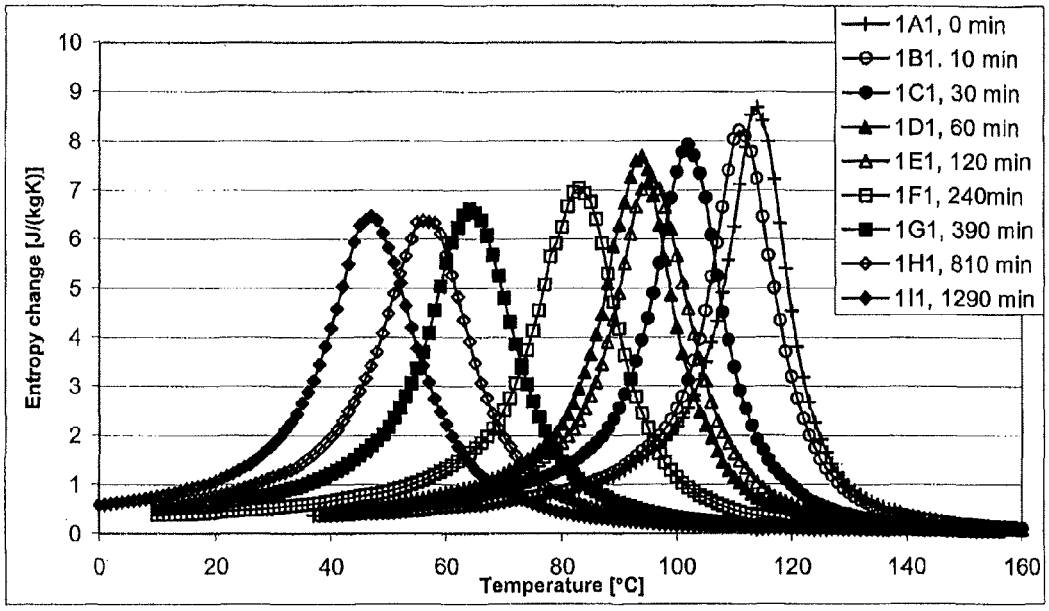
FIG. 4 illustrates a graph of entropy change as a function of temperature for articles dehydrogenated at 200° C. for different times.
Figure 5:
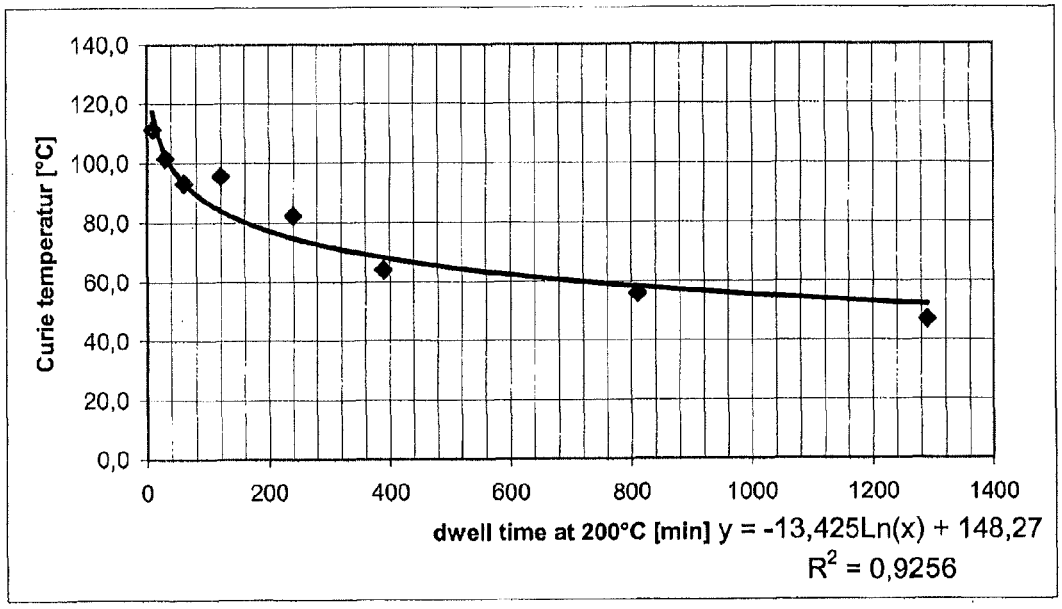
FIG. 5 illustrates a graph of Curie temperature as a function of dehydrogenation time for the articles of FIG. 4.

The results for samples heated at a temperature of 200° C. are summarised in Table 5. The entropy change at 1.6 T measured for these articles is illustrated in FIG. 4 and the dependence of the magnetic phase transition temperature as a function of dwell time at 200° C. is illustrated in FIG. 5.

TABLE 5

| sample | Dwell time at 200° C. | Entropy change $\Delta S'_{m.max}$, [J/(kg · K)] | Peak temperature $T_C$ [° C.] | Peak width $\Delta T_{WHH}$ [° C.] | Alpha Fe content [%] |
|---|---|---|---|---|---|
| VZ0826-1A1 | none | 8.30 | 113.6 | 14.3 | 6.7 |
| VZ0826-1B1 | 10 min | 7.91 | 111.3 | 15.0 | 7.6 |
| VZ0826-1C1 | 30 min | 7.62 | 101.5 | 15.7 | 8.6 |
| VZ0826-1D1 | 60 min | 7.37 | 93.1 | 16.1 | 8.2 |
| VZ0826-1E1 | 120 min | 7.00 | 95.6 | 17.3 | 8.4 |
| VZ0826-1F1 | 240 min | 6.87 | 82.3 | 18.5 | 8.3 |
| VZ0826-1G1 | 390 min | 6.45 | 64.0 | 19.2 | 8.9 |
| VZ0826-1H1 | 810 min | 6.30 | 55.9 | 20.0 | 8.6 |
| VZ0826-1I1 | 1290 min | 6.32 | 46.9 | 19.9 | 8.6 |

Figure 6:
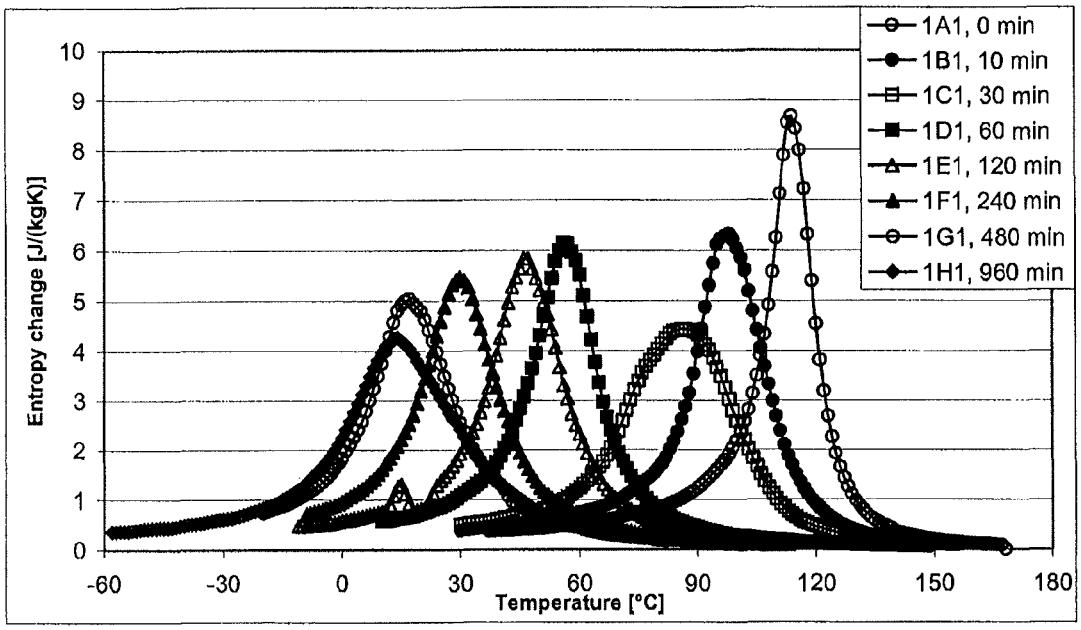
FIG. 6 illustrates a graph of entropy change as a function of temperature for articles dehydrogenated at 250° C. for different times.
Figure 7:
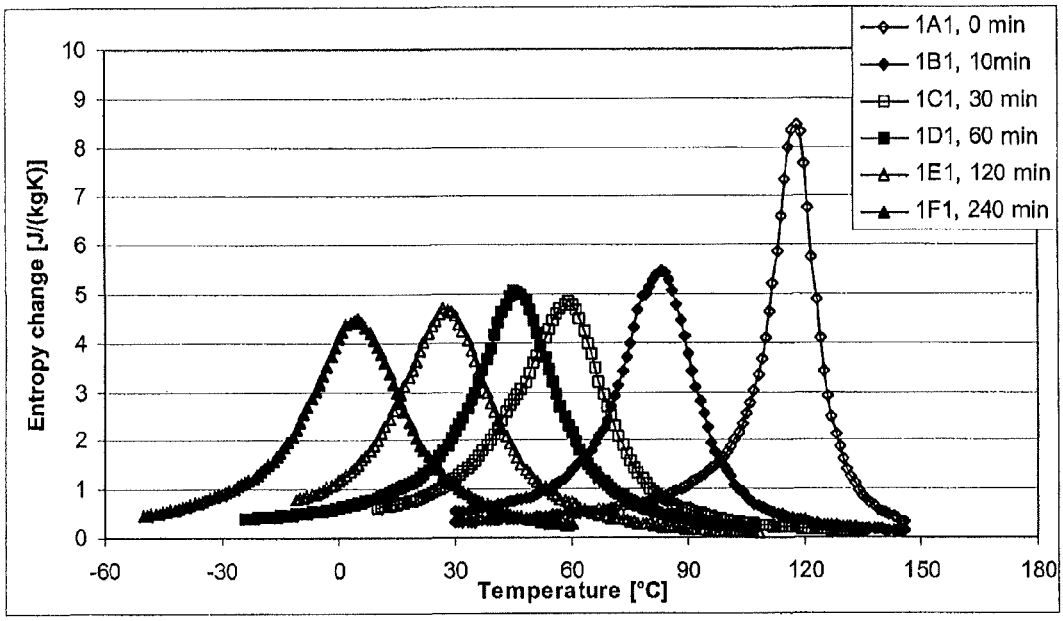
FIG. 7 illustrates a graph of entropy change as a function of temperature for articles dehydrogenated at 300° C. for different times.

The entropy change measured at 1.6 T for samples heated for different times at 250° C. and 300° C. are illustrated in FIGS. 6 and 7 and summarized in Tables 6 and 7.

TABLE 6

| Sample | Dwell time at 250° C. | Entropy change $\Delta S'_{m.max}$, [J/(kg · K)] | Peak temperature $T_C$ [° C.] | Peak width $\Delta T_{WHH}$ [° C.] | Alpha-Fe content [%] |
|---|---|---|---|---|---|
| VZ0826-1A1 | none | 8.30 | 113.6 | 14.3 | 6.7 |
| VZ0827-1B1 | 10 min | 6.24 | 98.2 | 21.0 | 8.3 |
| VZ0827-1C1 | 30 min | 4.42 | 85.4 | 33.0 | 8.8 |
| VZ0827-1D1 | 60 min | 6.01 | 55.9 | 20.4 | 10.1 |
| VZ0827-1E1 | 120 min | 5.68 | 46.5 | 22.5 | 9.5 |
| VZ0827-1F1 | 240 min | 5.37 | 29.6 | 23.7 | 10.4 |
| VZ0827-1G1 | 480 min | 4.95 | 17.4 | 26.2 | 11.1 |
| VZ0827-1H1 | 960 min | 4.20 | 15.5 | 33.3 | 11.9 |

TABLE 7

| Sample | Dwell time at 300° C. | Entropy change $\Delta S'_{m.max}$, [J/(kg · K)] | Peak temperature $T_C$ [° C.] | Peak width $\Delta T_{WHH}$ [° C.] | Alpha-Fe content [%] |
|---|---|---|---|---|---|
| VZ0828-1A1 | none | 8.16 | 117.0 | 14.5 | 6.9 |
| VZ0828-1B1 | 10 min | 5.38 | 81.8 | 23.4 | 10.1 |
| VZ0828-1C1 | 30 min | 4.76 | 56.2 | 29.0 | 11.2 |
| VZ0828-1D1 | 60 min | 4.99 | 45.0 | 26.1 | 10.4 |
| VZ0828-1E1 | 120 min | 4.63 | 26.8 | 29.5 | 10.5 |
| VZ0828-1F1 | 240 min | 4.44 | 4.0 | 30.3 | 12.5 |

Figure 8:
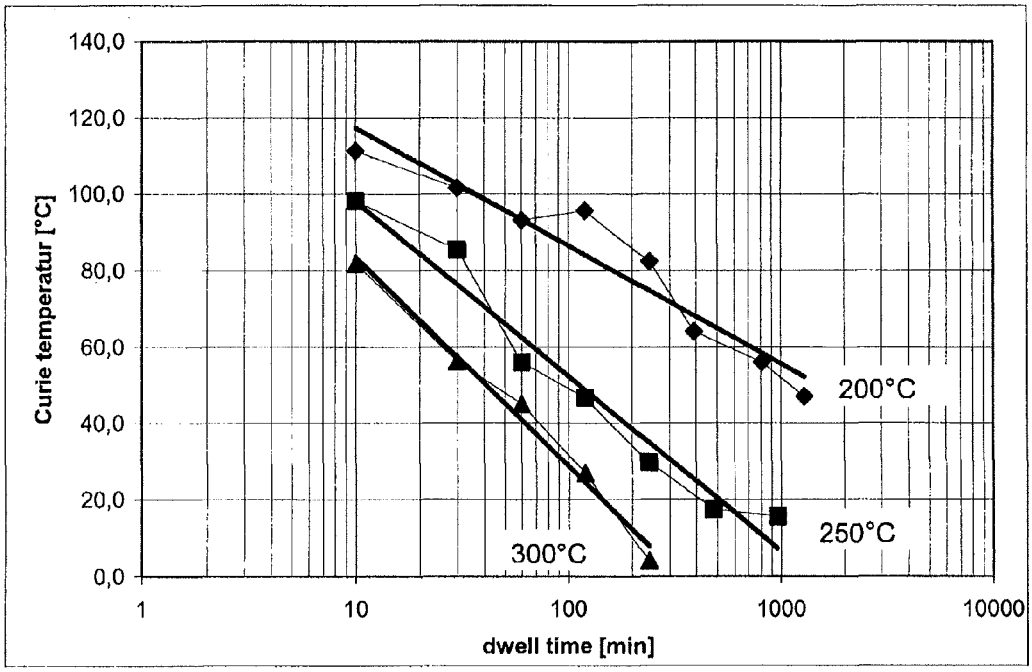
FIG. 8 illustrates a comparison of Curie temperature as a function of dehydrogenation time for the articles of FIGS. 4, 6 and 7.

The Curie temperature as a function of dwell time for articles heated at the three different temperatures are illustrated in the comparison of FIG. 8.

Generally, the magnetic phase transition temperature is reduced for increasing dwell time. Furthermore, for increased temperature, the reduction in the magnetic phase transition temperature occurs more quickly. The relationship between magnetic phase transition temperature and dwell time is approximately logarithmic for all three temperatures.

For a temperature of 250° C. and 300° C., the change in entropy is slightly reduced and the peak width is increased for the partially dehydrogenated samples in comparison to the fully hydrogenated precursor sample. This indicates that the dehydrogenation may be more inhomogeneous than that achieved at 200° C. although the dehydrogenation occurs more quickly. Additionally, the alpha iron content was found to increase at 250° C. and 300° C. which may indicate that some of the magnetocalorically active phase has decomposed due to oxidation.

Figure 9:
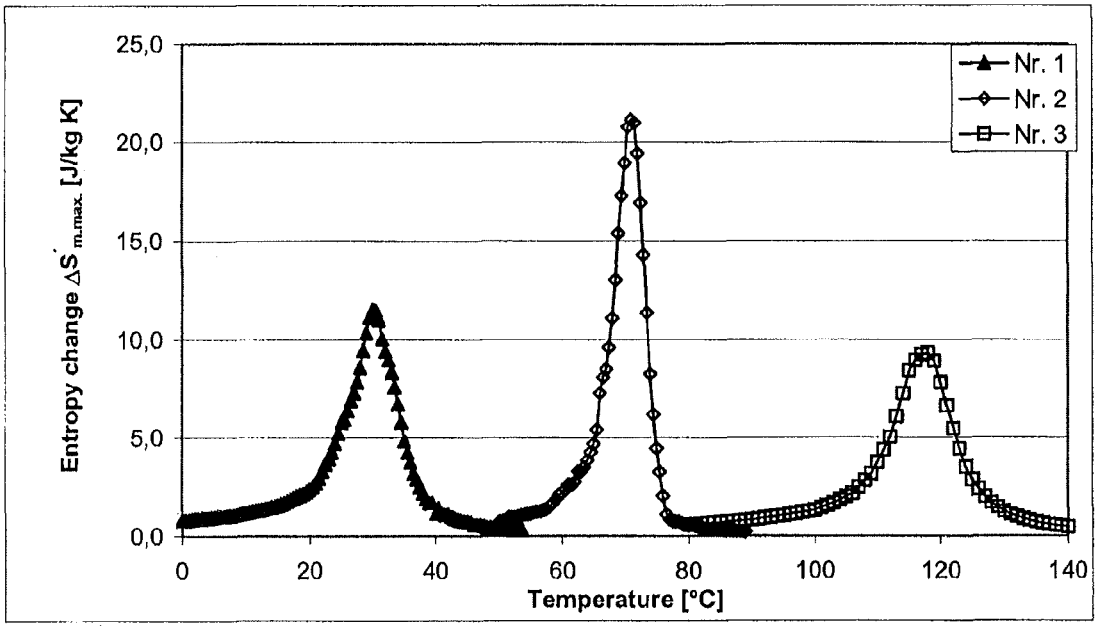
FIG. 9 illustrates a graph of entropy change as a function of temperature for three articles with differing metallic element compositions.

FIG. 9 illustrates a graph of entropy change as a function of temperature for three articles with differing metallic element compositions. The magnetocaloric properties are summarized in Table 8.

TABLE 8

| | Entropy change $\Delta S_{m.max}$, [J/(kg · K)] | Peak temperature $T_{PEAK}$ [° C.] | Peak width $\Delta T_{WHH}$ [° C.] | Alpha-Fe content [%] |
|---|---|---|---|---|
| Nr. 1 | 11.10 | 29.81 | 9.76 | 3.53 |
| Nr 2 | 20.24 | 70.64 | 6.24 | 4.35 |
| Nr. 3 | 8.97 | 117.06 | 12.09 | 6.58 |

Sample Nr. 1 has a composition of 17.88 wt % La, 4.34 wt % Si, 0.03 wt % Co and 1.97 wt % Mn, rest Fe. The Co and Mn is substituted for Fe. Sample 1 was sintered at 1120° C. and then annealed at 1050° C. Sample Nr 1 was subsequently hydrogenated by heating it from room temperature to 500° C. in an argon atmosphere and exchanging the gas for 1.9 bar of hydrogen at 500° C. After a dwell time of 15 min in the hydrogen atmosphere at 500° C., the sample was furnace cooled at an average cooling rate of 1K/minute in the hydrogen atmosphere to a temperature of less than 50° C.

Sample Nr. 2 has a composition of 17.79 wt % La, 3.74 wt % Si, 0.06 wt % Co and 0 wt % Mn, rest Fe. The Co is substituted for Fe. Sample 2 was sintered at 1100° C. and then annealed at 1040° C. Sample Nr 2 was subsequently hydrogenated by heating it up from room temperature to 500° C. in an argon atmosphere and exchanging the gas for 1.9 bar of hydrogen at 500° C. After a dwell time of 15 min in the hydrogen atmosphere at 500° C., the sample was furnace cooled at an average cooling rate of 1K/minute in the hydrogen atmosphere to a temperature of less than 50° C.

Sample Nr. 3 has a composition of 18.35 wt % La, 3.65 wt % Si, 4.51 wt % Co and 0 wt % Mn, rest Fe. The Co is substituted for Fe. Sample 1 was sintered at 1080° C. and then annealed at 1030° C. Sample Nr 3 was subsequently hydrogenated by heating it from room temperature to 500° C. in an argon atmosphere and exchanging the gas for 1.9 bar of hydrogen at 500° C. After a dwell time of 15 min in the hydrogen atmosphere at 500° C., the sample was furnace cooled at an average cooling rate of 1K/minute in the hydrogen atmosphere to a temperature of less than 50° C.

Table 8 illustrates that as the Co content is increased, the magnetic transition temperature increases. Sample 1 which includes Mn substitutions has a lower magnetic transition temperature.

A working medium for a magnetic heat exchanger is provided which comprises at least one article which comprises a $NaZn_{13}$-type crystal structure and hydrogen. The article may have at least one outer dimension which is at least 5 mm. For a working medium which includes two or more of these articles, the articles may have differing hydrogen contents and differing Curie or magnetic phase transition temperatures. The articles may be fully- or near fully hydrogenated as well as partially hydrogenated.

The partially hydrogenated articles may be produced by adjusting the temperature at which hydrogenation is carried out as well as by exchanging the hydrogen atmosphere for an inert atmosphere at the hydrogenation temperature or at temperatures above about 150° C. during the cooling of the article from the hydrogenation temperature.

For both fully-hydrogenated as well as partially hydrogenated articles, hydrogen is introduced into the furnace containing the articles only once the furnace has been heated up to a temperature above 300° C. This prevents the physical disintegration of the bulk precursor article so that a solid bulk article comprising hydrogen can be provided. Furthermore, the entropy change is largely unaffected by the hydrogenation treatment so that the hydrogenated article can provided an efficient working medium for a magnetic heat exchanger.

In a further method, fully or near fully hydrogenated articles are dehydrogenated to remove some or all of the hydrogen. Since the magnetic transition temperature depends on the hydrogen content, articles of different magnetic phase transition temperature may be provided by controlling the degree of dehydrogenation. Increased dwell times at temperatures in the range 150° C. and 400° C. lead to decreasing hydrogen content and decreasing magnetic transition temperature.

The invention having been described herein with respect to certain of its specific embodiments and examples, it will be understood that these do not limit the scope of the appended claims.

The invention claimed is:

1. A method of fabricating an article for magnetic heat exchange, comprising:

providing a bulk precursor article comprising a magnetocalorically active phase with a $NaZn_{13}$ crystal structure, performing hydrogenation of the bulk precursor article by:

heating the bulk precursor article from a temperature of less than 50° C. to at least 300° C. in an inert atmosphere, introducing hydrogen gas only when a temperature of at least 300° C. is reached, maintaining the bulk precursor article in a hydrogen containing atmosphere at a temperature in the range 300° C. to 700° C. for a selected duration of time, and cooling the bulk precursor article to a temperature of less than 50° C. to provide a hydrogenated article.

2. The method according to claim 1, wherein the cooling of the bulk precursor article to a temperature of less than 50° C. is in a hydrogen-containing atmosphere.

3. The method according to claim 2, wherein the selected duration of time is 1 minute to 4 hours.

4. The method according to claim 2, wherein after the hydrogenation, the article comprises at least 0.21 wt % hydrogen.

5. The method according to claim 2, wherein after the hydrogenation, the article comprises a magnetic phase transition temperature of in the range of −40° C. to +150° C.

6. The method according to claim 2, wherein the bulk precursor article is cooled at a rate of 0.1K/min to 10K/min.

7. The method according to claim 1, further comprising, before cooling the bulk precursor article to a temperature of less than 50° C., replacing the hydrogen gas by inert gas.

8. The method according to claim 7, wherein the selected duration of time is 1 minute to 4 hours.

9. The method according to claim 7, wherein after the hydrogenation, the article comprises a hydrogen content in the range of 0.02 wt % to 0.21 wt %.

10. The method according to claim 7, wherein the cooling of the bulk precursor article is cooled at a rate of 1 K/min to 100 K/min.

11. The method according to claim 1, wherein the cooling of the bulk precursor article to a temperature of less than 50° C. comprises cooling the bulk precursor article to a temperature in the range 300° C. to 150° C. in a hydrogen containing atmosphere, replacing the hydrogen by inert gas, and cooling the bulk precursor article to a temperature of less than 50° C.

12. The method according to claim 1, wherein the bulk precursor article has initial outer dimensions before hydrogenation and the article after hydrogenation has final outer dimensions, wherein a difference between the initial outer dimensions and final outer dimensions is less than 10 volume %.

13. The method according to claim 1, wherein the introducing of hydrogen gas is only when a temperature of 400° C. to 600° C. is reached.

14. The method according to claim 1, wherein the bulk precursor article has at least one outer dimension greater than 5 mm.

15. The method according to claim 1, wherein the bulk precursor article is polycrystalline.

16. The method according to claim 1, wherein the bulk precursor article is sintered or reactive sintered.

17. The method according to claim 1, wherein the magnetocalorically active phase is $La_{1-a}R_a(Fe_{1-x-y}T_yM_x)_{13}H_z$, wherein M is at least one element from the group consisting of Si and Al, T is at least one element from the group consisting of Co, Ni, Mn and Cr, R is at least one element from the group consisting of Ce, Nd and Pr, $0 \leq a \leq 0.5$, $0.05 \leq x \leq 0.2$, $0 \leq y \leq 0.2$ and $0 \leq z \leq 3$.

* * * * *